United States Patent [19]

Evans et al.

[11] Patent Number: 4,960,507

[45] Date of Patent: Oct. 2, 1990

[54] TWO-STEP HETEROCYCLIC NITROGEN EXTRACTION FROM PETROLEUM OILS

[75] Inventors: Wayne E. Evans, Richmond; George C. Blytas, Houston, both of Tex.

[73] Assignee: Shell Oil Company, Houston, Tex.

[21] Appl. No.: 418,070

[22] Filed: Oct. 6, 1989

Related U.S. Application Data

[63] Continuation-in-part of Ser. No. 325,707, Mar. 20, 1989, abandoned.

[51] Int. Cl.[5] ..... C10G 17/04

[52] U.S. Cl. ..... 208/254 R; 208/177

[58] Field of Search ..... 208/254 R

[56] References Cited

U.S. PATENT DOCUMENTS

| | | | |
|---|---|---|---|
| 1,686,136 | 10/1928 | Ihrig | 260/264 |
| 2,263,175 | 11/1941 | Lazar et al. | 260/269 |
| 2,263,176 | 11/1941 | Lazar et al. | 260/269 |
| 2,309,324 | 1/1943 | McAllister et al. | 260/290 |
| 2,352,236 | 6/1944 | Thomas | 196/39 |
| 2,518,353 | 8/1950 | McKinnis | 196/44 |
| 4,209,385 | 8/1980 | Stover | 208/254 R |
| 4,271,009 | 6/1981 | Stover et al. | 208/254 R |
| 4,272,361 | 6/1981 | Compton | 208/254 R |
| 4,332,675 | 6/1981 | Baset | 208/254 R |
| 4,332,676 | 6/1982 | Baset | 208/254 R |
| 4,409,092 | 10/1983 | Johnson et al. | 208/89 |
| 4,426,280 | 1/1984 | Chen et al. | 208/254 R |
| 4,671,865 | 6/1987 | Madgavkar et al. | 208/96 |
| 4,749,472 | 6/1988 | Madgavkar et al. | 208/254 R |
| 4,790,930 | 12/1988 | Madgavkar et al. | 208/254 R |

OTHER PUBLICATIONS

*Chemical Engineering,* Desai, Asim and Madgavkar, Aug. 1983.

*Primary Examiner*—Helane Myers

*Attorney, Agent, or Firm*—Pamela J. McCollough

[57] ABSTRACT

A process for the removal of basic heterocyclic nitrogen compounds from petroleum oils which comprises:

(a) contacting said petroleum oils containing basic heterocyclic nitrogen compounds with an aqueous solution of an acidic solvent at extraction conditions in a first contacting zone, (b) separating the product of step (a) into a raffinate product stream comprising hydrocarbons having a lean content of basic heterocyclic nitrogen compounds and residual acid levels, and a first extract phase comprising hydrocarbons, water and acid having a substantial content of basic heterocyclic nitrogen compounds, (c) contacting said first extract phase with a hydrocarbon solvent which is substantially immiscible with said first extract phase at extraction conditions in a second contacting zone, and (e) separating the product of step (c) into a hydrocarbon recovery stream comprising the immiscible hydrocarbon solvent and oil-derived hydrocarbons having a lean content of basic heterocyclic nitrogen compounds and a second extract phase comprising acid, water and a decreased amount of nitrogen-free hydrocarbons and having a high content of basic heterocyclic nitrogen compounds.

29 Claims, 2 Drawing Sheets

TWO-STEP HETEROCYCLIC NITROGEN EXTRACTION FROM PETROLEUM OILS

This is a continuation-in-part of co-pending application Ser. No. 325,707, filed Mar. 20, 1989 now abandoned.

FIELD OF THE INVENTION

The field of this invention resides in the removal of nitrogen compounds from fossil fuels, inclusive of petroleum oils. This invention seeks to remove basic nitrogen from high-nitrogen petroleum oils such as those derived from West Coast North American crudes.

INTRODUCTION

Nitrogen compounds create a major problem in refinery processing by deactivating cracking and hydroprocessing catalysts. Various prior methods have been employed for separating nitrogen compounds from petroleum oils, such as the use of gaseous sulfur dioxide and the use of inorganic acids.

Basic nitrogen compounds can be removed from oil by extraction with an acidic solvent. However, the process is usually less than 100% selective; some nitrogen-free hydrocarbon oil is also dissolved into the acidic phase. This nitrogen-free hydrocarbon oil will be rejected from the raffinate stream along with the high-nitrogen extract, and thus represents a loss of raffinate yield. Raffinate yield losses are particularly high, i.e., the selectivity of the process is particularly low, when a very high fraction of the basic nitrogen present in the oil must be removed. At "deep" basic nitrogen removal, the ratio of pure hydrocarbon to basic nitrogen remaining in the oil becomes very large, thus favoring the dissolution of nitrogen-free oil, rather than basic nitrogen, into the acidic phase. Further, as more and more basic nitrogen is removed, the basic nitrogen compounds remaining in the oil phase are, by definition, the least acid-soluble. In order for an extraction process to be commercially viable, the selectivity of the extraction process must be high, which is to say, losses of nitrogen-free hydrocarbon into the extract stream must be low.

This invention seeks to improve the selectivity of a basic nitrogen extraction process. When the process of the instant invention is utilized, the extract stream generated by the two-step extraction contains a higher fraction of basic nitrogen material and a lower fraction of nitrogen-free hydrocarbons, relative to conventional basic nitrogen extraction processes. While it is not feasible to remove all nitrogen compounds from petroleum oils by an extraction process, it is preferred that the content of the nitrogen compounds be reduced to the practical minimum in order to reduce the poisoning of catalysts in downstream processing. As used herein, the term "petroleum oils" includes petroleum oils, shale oils and tar sand-derived oils.

The key aspect of this invention resides in a two-step extraction process. In the first step of the process, the basic nitrogen concentration of the feed is reduced by extraction with an acidic solvent. The extract from this first step contains a high concentration of basic nitrogen, but may also contain a considerable amount of nitrogen-free oil. In the second step of the process, the extract from the first step is contacted with an immiscible hydrocarbon solvent, resulting in the transfer of nitrogen-free oil from the extract of the first step into the hydrocarbon solvent, while leaving most of the nitrogen-containing species in the extract phase. Said hydrocarbon solvent phase can be flashed to recover the solvent. The isolated nitrogen-free oil can be recycled, i.e., added back to the feed stream of the first step of the process, or can be combined with the raffinate stream of the process.

The two-step process of the instant invention is superior to a single-step extraction because the selectivity of the two-step process is higher. Higher selectivity is equivalent to a higher yield of denitrogenated product raffinate.

BACKGROUND OF THE INVENTION

In addition to hydroprocessing, other techniques have been disclosed for the removal of nitrogen compounds. Recently, two U.S. Pat. Nos. issued to Baset, 4,332,676 and 4,332,675, which disclose a process for the removal of basic nitrogen compounds from organic streams inclusive of petroleum oils utilizing gaseous sulfur dioxide to thereby precipitate a salt comprising the basic nitrogen compound, sulfur dioxide and water with downstream separation of the precipitated salt. Both of these patents concern a single phase treatment system with an essentially water-free separation system in '675 and only enough water in '676 such that a single phase system is existent. In fact, in the latter reference, the addition of water is limited to a concentration only to the extent that a two-phase liquid system will never be formed. It is also disclosed that a non-polar solvent can be utilized in the contacting step such as petroleum ether, a lower paraffinic hydrocarbon or an aromatic hydrocarbon such as toluene. While the types of basic organic nitrogen compounds extracted in the first step of the instant invention are either similar to or the same as those described in Column 2 of the '676 disclosure, the means by which the process is undertaken in the instant invention is very different from that disclosure.

In the October 1983 issue of *Chemical Engineering*, an article by Desai and Madgavkar recognized a method to remove nitrogen compounds from shale oil by solvent extraction with a formic acid/water solvent prior to hydrotreating. The advantage of this technique is a reduced hydrogen consumption and a reduction of the nitrogen content to a level that allows downstream processing of the shale oil.

The use of inorganic acids to petroleum oils to reduce the quantity of nitrogen compounds has long been established. For example, in U.S. Pat. No. 2,352,236, anhydrous hydrogen chloride is added to improve a charge stock for catalytic cracking. A dilute acid, such as sulfuric acid, is disclosed in U.S. Pat. No. 1,686,136 to complex nitrogen compounds existent in a California-derived crude oil. Organic carboxylic acids, sometimes referred to as low molecular weight fatty acids of high volatility, have been used to complex nitrogen-bases in such disclosures as U.S. Pat. Nos. 2,263,175 and 2,263,176. While these latter two references employ a portion of the chemical mechanism utilized in the first step of this two-step nitrogen extraction process they fail to disclose, suggest or even hint at the use of a second extraction step with an immiscible hydrocarbon solvent to improve the selectivity of the process, which results in a higher overall yield of denitrogenated raffinate. Also, these references fail to teach the use of two extraction steps, one utilizing an acidic solvent and one utilizing an immiscible hydrocarbon solvent.

A patent issued to Madgavkar et al, U.S. Pat. No. 4,671,865, discloses a two step process for removing heterocyclic nitrogen from petroleum oils. The patent describes the combination of hydrotreatment followed by acid extraction for removing nitrogen from petroleum oil.

U.S. Pat. No. 4,426,280 discloses the removal of nitrogen from shale oil by contacting an oil stream with a dilute acid followed by contacting the oil stream with a concentrated acid.

A patent issued to Johnson et al, U.S. Pat. No. 4,409,092, in 1983 teaches formation of a high nitrogen fraction and a low nitrogen fraction, which is then subjected to phosphoric acid extraction. The fraction high in nitrogen content is catalytically cracked and then either hydrotreated or sent to phosphoric acid extraction. There is no disclosure by Johnson et al of a two-step extraction process whereby extraction of petroleum oil is made in the presence of a concentrated acid extraction agent and then subsequently the extract from the first extraction is contacted with an immiscible hydrocarbon solvent, thus improving the overall yield of denitrogenated raffinate.

Thus, the extraction of basic heterocyclic nitrogen compounds from petroleum oils using acidic solvents is an established technique. However, such solvents extract not only nitrogen containing materials from the oil, but can dissolve substantial amounts of nitrogen-free hydrocarbon as well. Nitrogen-free hydrocarbon adsorption by the acid phase constitutes a loss in raffinate yield. Such losses are particularly high when a high percentage of the basic nitrogen present in the feed must be removed. Accordingly, it has been found that a specific two step extraction procedure can substantially improve process selectivity and denitrogenated raffinate yield.

SUMMARY OF THE INVENTION

This invention relates to a process for the removal of basic heterocyclic nitrogen compounds from petroleum oils which comprises: (a) contacting said petroleum oils containing said basic heterocyclic nitrogen compounds with an aqueous solution of an acidic solvent at extraction conditions in a first contacting zone, (b) separating the product of step (a) into a raffinate product stream comprising hydrocarbons having a lean content of basic heterocyclic nitrogen compound and residual acid levels and a first extract phase comprising hydrocarbons, water and acid and having an increased content of basic heterocyclic nitrogen compounds, (c) contacting said first extract phase with an immiscible hydrocarbon solvent at extraction conditions in a second contacting zone, (d) separating the product of step (c) into a hydrocarbon recovery stream comprising the immiscible hydrocarbon solvent and oil hydrocarbons having a lean content of basic heterocyclic nitrogen compounds and a second extract phase comprising acid, water and a decreased amount of nitrogen-free hydrocarbons, and having a high content of basic heterocyclic nitrogen compounds, and (e) flashing said hydrocarbon recovery stream to remove excess hydrocarbon solvent.

It has been found that the process according to the invention results in improved selectivity for removal of nitrogen-containing compounds, resulting in increased hydrocarbon recovery.

DESCRIPTION OF THE PREFERRED EMBODIMENTS

Figure 1:
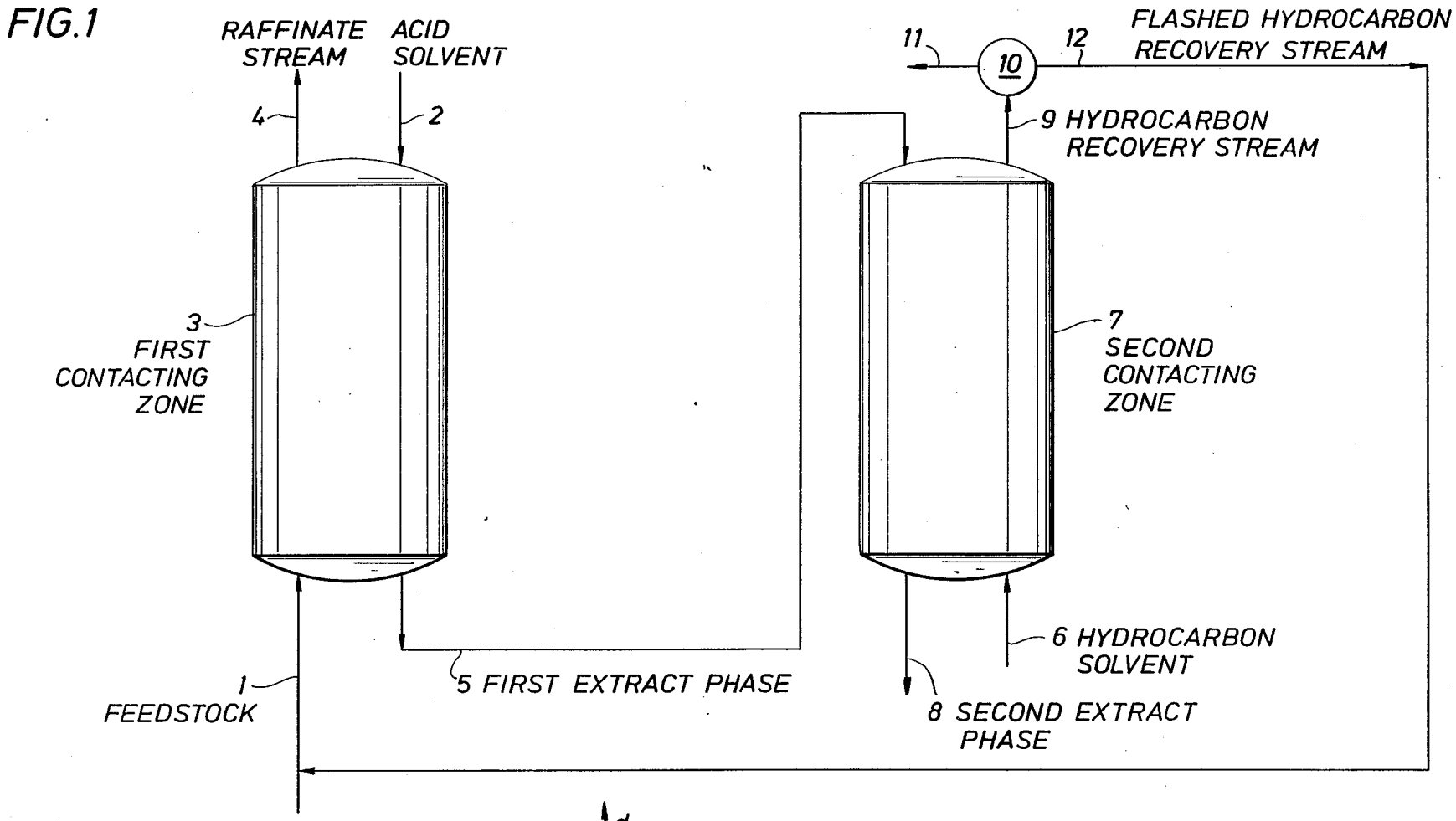
FIG. 1 is a flow diagram of the preferred embodiment of the invention in which the flashed hydrocarbon recovery stream resulting from the second contacting zone is recycled to the first contacting zone.

This invention relates to a process for the removal of basic heterocyclic nitrogen compounds from petroleum oils. In this invention, a two-step heterocyclic nitrogen removal process functions on a crude oil or fraction thereof to extract nitrogen compounds therefrom and to maintain a high recovery of nitrogen-free hydrocarbon from the process. The first step entails extraction with an acidic solvent to remove difficult to extract to heterocyclic nitrogen compounds. The second step entails contacting the extract from the first step with an immiscible hydrocarbon solvent to improve the selectivity of the extraction process.

The present invention is not concerned with how the petroleum oils having basic heterocyclic nitrogen compounds contained therein are derived. The various fossil fuels may be either crude oils naturally derived from geological sources, distillation fractions of crude oils, or oils previously treated to modify the molecular structure of the fuels. Thus, crude oils from such fields as those west of the Rocky Mountains which are very high in nitrogen compounds, are clearly contemplated to be within the scope of this invention. Also, gas oils and other refinery streams such as fluid catalytic cracking feed material, coker gas oils, vacuum distillate oils, etc., are contemplated to be within the confines of this invention. If desired, the petroleum oil may be distilled or fractionated or hydrotreated in a separation zone prior to extraction to concentrate the problem causing nitrogen compounds into a select special stream, i.e. a distillate bottoms stream. In this manner, a refiner may quickly arrive at a processable stream and concentrate all of the nitrogen-containing compounds into a segregated portion of the refinery.

As used herein, "acids" may be organic or inorganic or mixtures of two or more acids. It is preferred that organic acids be used since inorganic acids have a greater tendency to form emulsions with petroleum oils and therefore require greater separation times.

The extraction agent utilized in the first contacting zone of this two-step extraction process is commonly referred to as a complexing or extraction solvent and comprises an aqueous solution of an acid. The first contacting or extraction step is a conventional process of extraction utilizing an acidic solvent. The acidic solvent utilized in the first contacting zone will typically be in the range of from about 25% by weight to about 99% by weight, preferably about 75% to about 95% by weight of acid, per total weight of solvent. Suitable acids include aliphatic organic carboxylic acids and halogensubstituted carboxylic acids. Typically, carboxylic acids utilized contain 1 to about 15 carbon atoms as exemplified by formic acid, acetic acid, propionic acid, n-butyric acid, isobutyric acid, valeric acid, trimethylacetic acid, caproic acid, n-heptylic acid, caprylic acid, nonanoic acid, decanoic acid, undecanoic acid, dodecanoic acid, tridecanoic acid, tetradecanoic acid, pentadecanoic acid, etc. It is also contemplated that the acidic solvent may be a mixture of two or more acids. It is further contemplated that one or more of the hydrogen atoms of the aliphatic carboxylic acid be substituted by moieties chosen from the halogen group of the Periodic Table. Such halogen moieties are one or more of fluoro-, chloro-, bromo-, and iodo-moieties. Exemplary of these substituted carboxylic acids are fluoroacetic acid, chloroacetic acid, bromoacetic acid, iodoacetic acid, dichloroacetic acid, trichloroacetic acid, alpha-chloropropionic acid, beta-chloropropionic acid, trifluoroacetic acid, etc.

The acids utilized in the present invention may be present with an inert co-solvent. This co-solvent is described as being inert in character in that it does not function as a complexing agent for heterocyclic basic hydrogen compound. It is necessary in some cases to have this co-solvent present to facilitate intimate phase contact between the two-phase system of the petroleum oil and the acid solvent. These co-solvents can be considered a mixing means or as an aid to a mixing means. Examples of such inert co-solvents comprise $C_5$ to $C_{12}$ paraffins such as pentane, hexane, heptane, octane, nonane and decane; aromatic hydrocarbons such as benzene, toluene or xylenes; $C_1$ to $C_{12}$ alkanols such as methanol, ethanol, propanol, butanol, pentanol, hexanol, heptanol, octanol, nonanol, decanol, and a naphtha solvent boiling in the range of 120° F. to about 450° F. or even any admixture of the respective co-solvents.

The quantity of acidic solvent necessary to solubilize the heterocyclic basic nitrogen compounds in the first extraction zone varies with different solvents and different feedstocks. In the practice of this invention, it is preferred that at least about 0.1 liter of concentrated acid solvent be present for each liter of petroleum oil treated. Most preferably, about 0.2 to about 3.0 liters of concentrated acid solvent per liter of petroleum oil treated will be present in the extraction zone having two phases contained therein. It is of course possible that a larger amount of the concentrated acid solvent can be utilized than is necessary to adequately solubilize the heterocyclic basic nitrogen compounds. However, when an excessive amount of concentrated acid solvent is utilized, the selectivity of the extraction process is diminished.

The first step of the process of this invention concerns a two-phase system for complexing and extracting the heterocyclic basic nitrogen compounds entrained in a petroleum oil. One phase is a petroleum oil containing the heterocylic basic nitrogen compounds while the second phase is an aqueous phase having an organic or inorganic acid dissolved therein. The quantity of water in the aqueous phase must be sufficient to insure creation and maintenance of a two phase system, that is to say, to insure that the phases remain immiscible. The concentration of the acid in the aqueous phase in the first extraction zone will typically be from about 25 to about 99 percent by weight, preferably about 75 to about 95 percent by weight, per total weight of solvent.

The amount and type of heterocyclic basic nitrogen compounds is ascertained by a chemical analysis of a sample of the applicable petroleum oil or fraction of the petroleum oil. While not wishing to be bound by any specific heterocyclic basic nitrogen compound, it is believed that the most prevelant nitrogen compounds in petroleum oils are those in which the nitrogen atom is contained in a 5-membered or 6-membered ring, the rings being either unsaturated or saturated.

The extraction conditions utilized in the first contacting zone include a temperature ranging from ambient to about 300° F., and a pressure ranging from 1 atmosphere to about 20 atmospheres. A preferred range of extraction conditions includes a temperature of from about 70° F. to about 180° F. and a pressure of from about 1 atmospheres to about 2 atmospheres. A most preferred range of extraction conditions includes a temperature of from about 120° F. to about 160° F., and a pressure of about 1 atmosphere. The contacting vessel utilized in this invention can be any conventional solvent extraction equipment which provides a mixing means for adequate intermixture of the two-phase system. Such contactors are commonplace in the art and are exemplified by such apparatus as a mixer-settler, a rotating disc contactor, a pulsating column, and the like. Addition means are also provided for the entry of extractant into the contacting zone. This means can comprise any type of valve or conduit which provides ready access to the interior of the contacting zone. The addition means can be constructed to pass new extractant, new and recycle extractant, or only recycle extractant to the first extraction zone.

Following the mixing of acid solvent and oil and the subsequent formation of distinct phases in the first contactor, the phases are physically separated. The upper phase is a raffinate product stream which consists primarily of hydrocarbon, with some basic nitrogen material plus residual levels of acid present. This phase is flashed at a temperature above the boiling point of the acid but below the initial boiling point of petroleum oil, resulting in a raffinate product stream from which basic nitrogen has been depleted. If desired, this denitrogenated raffinate product stream is suitable for further processing by, for example, a catalytic cracker.

The lower phase is a first extract phase and consists of acidic solvent, protonated basic nitrogen materials and dissolved nitrogen-free hydrocarbons, and thus constitutes a loss in the volume of the raffinate product stream. The extract phase can be passed directly to the second step of the process. Alternatively, prior to entering the second step of the process, the extract phase can be partially flashed. This partial flash reduces the volume of extract phase that must be treated in the second step of the process, and also increases the concentration of basic nitrogen materials and nitrogen-free hydrocarbons in the extract phase. As a third option, prior to entering the second step of the process, the extract phase can be deeply flashed and controlled amounts of acidic solvent added back to the extract material. In this fashion, the volume and concentration of the extract phase passed to the second step of the process can be easily controlled. It should be noted that complete flashing of the extract without the re-addition of some acidic solvent is not recommended, because the basic nitrogen materials should remain protonated and should remain in a somewhat polar solvent in order for the second step of the process to proceed correctly.

The second step of this invention involves contacting the extract phase from the first step with a hydrocarbon solvent that is substantially immiscible with the first extract phase. By substantially immiscible, it is meant that less than about 5 percent by weight, preferably less than about 3 percent by weight and more preferably, less than about 1 percent by weight of the hydrocarbon solvent is soluble in the first extract phase. In general, non-polar hydrocarbon solvents are preferable. As used herein, "non-polar" shall mean solvents exhibiting dielectric constants of less than 10. Examples of suitable hydrocarbon solvents are: $C_3$–$C_{12}$ paraffins: $C_3$–$C_{12}$ olefins; such as $C_3$–$C_{12}$ ethers, etc. The key feature of these solvents is that they dissolve nitrogen-free hydrocarbons to a substantially higher degree than they dissolve the more polar nitrogen-containing hydrocarbons found in refinery streams. Thus, when a hydrocarbon solvent is contacted with an extract phase that contains both nitrogen-free and nitrogen-containing oil materials, the nitrogen-free materials will disproportionate into the hydrocarbon solvent to a much higher degree than will the nitrogen-containing materials. If the relative volumes of hydrocarbon solvent and extract phase are properly chosen, the net result of the contacting step is the migration of a large fraction of the nitrogen-free materials from the extract phase into the hydrocarbon solvent phase, accompanied by only a small migration of the nitrogen-containing materials.

For example, it has been found that by using octane as hydrocarbon solvent and acetic acid as acidic solvent, the ratio of nitrogen-free oil distribution coefficient to basic nitrogen distribution coefficient ranges between 22 and 159. Nitrogen-free oil distribution coefficient is defined as the weight of nitrogen-free oil dissolved in the hydrocarbon solvent phase divided by the weight of nitrogen-free oil dissolved in the the extract (i.e., acidic) phase, at equilibrium. Basic nitrogen distribution coefficient is defined as the weight of basic nitrogen containing oil dissolved in the hydrocarbon solvent phase divided by the weight of basic nitrogen containing oil dissolved in the extract phase, at equilibrium. The values of these two coefficients vary as the extracting acid, acid concentration, and volume ratio of hydrocarbon solvent/acid phase are changed. The ratio of the two distribution coefficients indicates the selectivity with which the hydrocarbon solvent removes the desired nitrogen-free oil from the extract phase without removing nitrogen-containing species. The ratio of nitrogen-free oil distribution coefficient to basic nitrogen distribution coefficient must be greater than 1 in order for the process to work, but is preferably greater than about 10 and more preferably, greater than about 20.

As in the first contacting zone, the conditions utilized in the second contacting zone include a temperature ranging from ambient to about 300° F. and a pressure ranging from 1 atmosphere to about 20 atmospheres. A preferred range of extraction conditions includes a temperature of from ambient to about 150° F. and a pressure of from about 1 atmosphere to about 5 atmospheres, with a most preferred range of extraction conditions being a temperature of from about ambient to 160° F., and a pressure of about 1 atmosphere.

In the second contacting zone, it is preferred that about 0.01 to about 5.0 liters of immiscible hydrocarbon solvent be present for each liter of extract stream present. Most preferably, about 0.05 to about 1.0 liters of immiscible hydrocarbon solvent will be present in the second contacting zone.

Following contacting and phase coalescence in the second contacting zone, the product is separated into a hydrocarbon recovery stream which is then flashed to remove hydrocarbon solvent, and a second extract phase which comprises acid, water, basic heterocyclic nitrogen compounds and a decreased amount of nitrogen-free hydrocarbons.

Much of the nitrogen-free hydrocarbon present in the first extract phase is tranferred to the non-polar hydrocarbon solvent during the second contacting step. However, nitrogen materials in the first extract phase are present as protonated salts, which are relatively polar, and consequently are much less soluble in the non-polar hydrocarbon solvent than in the extract phase. Nitrogen materials thus remain predominantly in the extract phase throughout the second contacting step. The recovery stream from the second contacting zone contains a substantially higher ratio of nitrogen-free hydrocarbons versus nitrogen materials than does the extract from the first contacting zone. In a preferred embodiment, the recovery stream is recycled by adding it to the petroleum oil which is scheduled to be extracted in the first contacting zone. In a second embodiment, the hydrocarbon recovery stream is combined with the denitrogenated raffinate stream from the first contacting zone and passed to a catalytic cracker or other refinery unit for further processing. Although the hydrocarbon recovery stream from the second extraction has a higher basic nitrogen level than does the raffinate stream from the first contacting zone, its volume is typically less than about 5% of the product raffinate stream from the first contacting zone. Thus, passing the hydrocarbon recovery stream along with the product raffinate stream from the first contacting zone to the catalytic cracker would substantially improve the selectivity of the overall process, with the net removal of basic nitrogen being only slightly reduced. The extract phase which results from the second contracting zone has an increased basic nitrogen content and a diminished nitrogen-free oil content, as compared with the extract phase from the first contacting zone. Thus, the result of the second contacting step is a substantial improvement in the overall raffinate yield of the process.

The two-step process of the instant invention is therefore superior to a single-step extraction because the selectivity of the two-step process is higher. Higher selectivity is equivalent to a higher yield of denitrogenated product raffinate.

DETAILED DESCRIPTION OF THE DRAWINGS

Figure 1A:
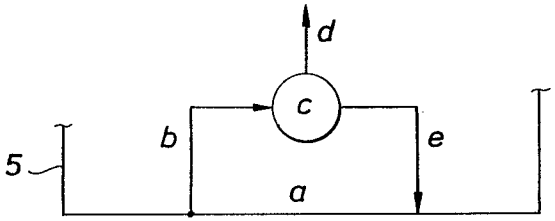
FIG. 1A is a section of FIG. 1 and is a preferred way of carrying out the process depicted in FIG. 1 in which the extract phase from the first contacting zone is flashed prior to being passed to the second contacting zone.

While not wishing to be bound by any specific flow scheme herein, FIG. 1 is representative of the preferred embodiment of this invention. Although shown as two distinct units in FIGS. 1 and 2, it is contemplated that the functions of the two contacting zones could be performed in one physical unit, such as a rotating disc contactor. Fresh petroleum oil having a high content of nitrogen compounds is added through conduit 1 to first contacting zone 3. If desirable, fresh oil feed in conduit 1 may be heated in a heating zone (not shown) prior to addition to extraction in first contacting zone 3. If desired, a distillation step may be performed on the fresh oil feed and only a portion passed to first contacting zone 3. In contacting zone 3, two phases are formed. A first phase comprises a raffinate stream from which heterocyclic nitrogen compounds have been extracted by means of an acidic solvent which is added to contacting zone 3 through conduit 2. The two phases formed in contacting zone 3 are removed as raffinate stream 4 and first extract phase 5. Each phase is treated differently, derivative of its make up. Raffinate stream 4 contains petroleum oil having a reduced quantity of heterocyclic nitrogen compounds compared to the fresh feed oil. The raffinate stream 4 may be passed, for example, to a catalytic cracker for further processing. It may be desirable to separate dissolved solvent from the raffinate stream by flashing, prior to downstream use. The first extract phase 5 is then passed into second contacting zone 7. In a preferred embodiment of the process depicted in FIG. 1, as shown in FIG. 1A, the first extract phase 5 may be passed through conduit b into flashing zone c and either partially or fully flashed prior to being passed through conduit e into second contacting zone 7. When the first extract phases is fully flashed, it is desirable that some acidic solvent from the first contacting zone be added back to the first extract phase 5 prior to passing it into the second contacting zone 7. In second contacting zone 7, two phases are formed. A first phase comprises a hydrocarbon recovery stream 9 from which nitrogen-free hydrocarbons have been extracted by means of a hydrocarbon solvent 6. The second extract phase 8, a stream having a high nitrogen compounds content is removed from second contacting zone 7. This stream would be flashed to recover and recycle the hydrocarbon solvent contained in the stream, prior to utilization of the extract. The hydrocarbon recovery stream 9 is removed from second contacting zone 7 and flashed in flashing zone 10 to remove the hydrocarbon solvent. The hydrocarbon solvent is removed from the system to recycle via conduit 11. The flashed hydrocarbon recovery stream 12 is then combined with fresh oil feedstock in conduit 1 and recycled to first contacting zone 3 for further processing.

Figure 2:
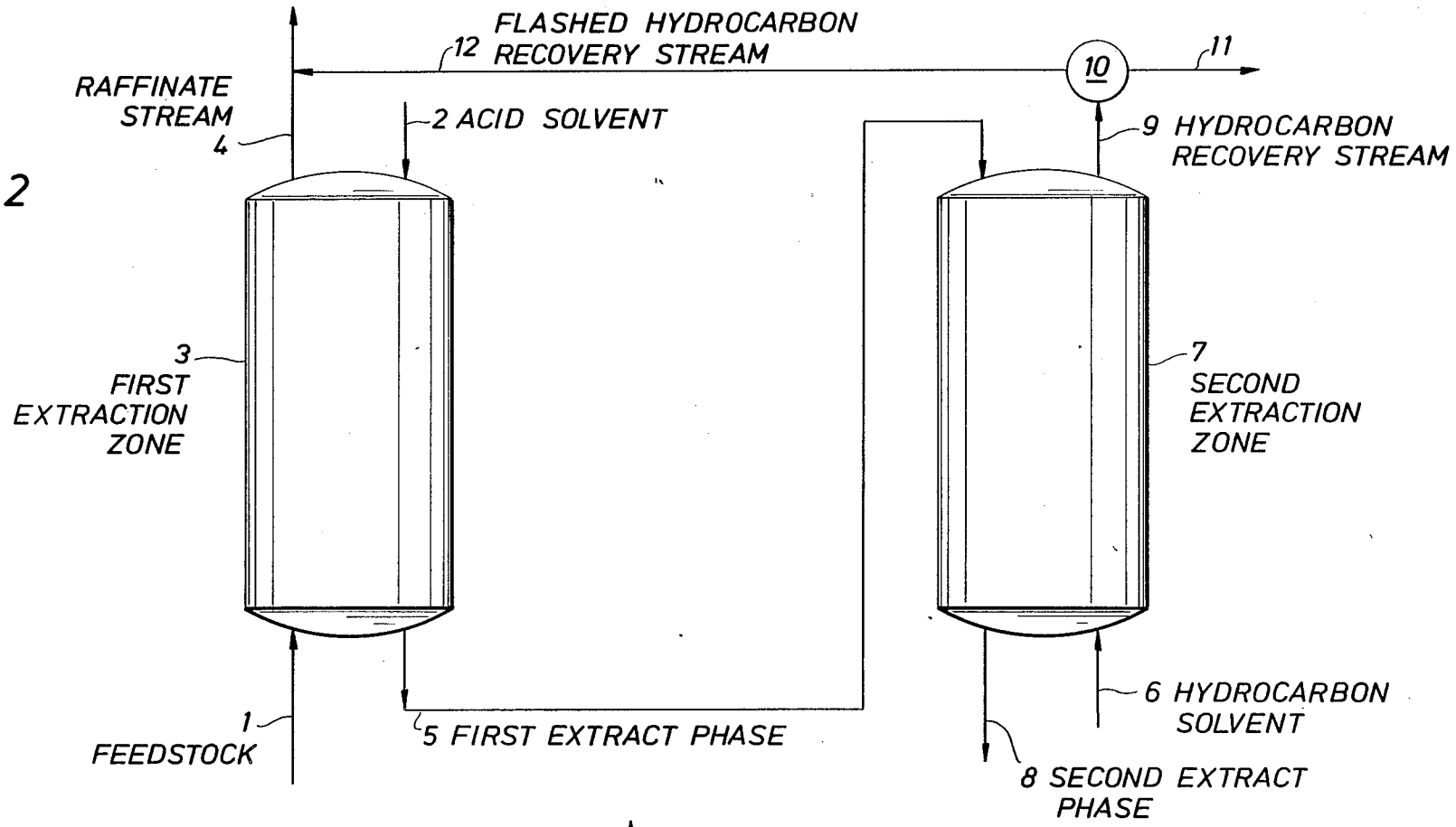
FIG. 2 is a flow diagram of a second embodiment of the invention in which the flashed hydrocarbon recovery stream resulting from the second contacting zone is combined with the raffinate product stream from the first contacting zone and passed to a catalytic cracker.
Figure 2A:
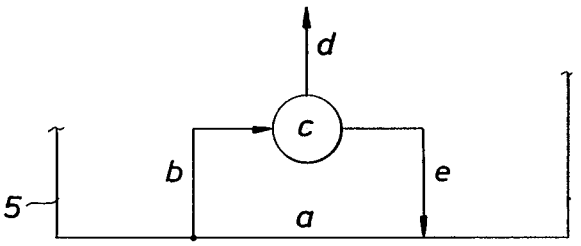
FIG. 2A is a section of FIG. 2 and is a preferred way of carrying out the process depicted in FIG. 2 in which the extract phase from the first contacting zone is flashed prior to being passed to the second contacting zone.

FIG. 2 is representative of another embodiment of this invention. The process in FIG. 2 differs from that illustrated in FIG. 1 in that the flashed hydrocarbon recovery stream 12 is combined with raffinate stream 4 and passed, for example, to a catalytic cracker for further processing downstream through conduit 16 rather than being recycled as in the embodiment illustrated in FIG. 1. FIG. 2A represents a preferred embodiment of the process depicted in FIG. 2 in which the first extract phase 5 can be passed through conduit b and partially flashed in flashing zone c or fully flashed in flashing zone c prior to being passed through conduit e into second contacting zone 7. When the first extract phase 5 is fully flashed, it is desirable that some acidic solvent from the first contacting zone be added back to the first extract phase 5 prior to passing it into the second contacting zone 7.

ILLUSTRATIVE EMBODIMENTS

The illustrative embodiment described herein is exemplary of this process and is not given to having a limiting effect upon the claims hereinafter presented.

Example 1

Example 1 illustrates the embodiment of the invention depicted in FIG. 1. In this example, a hydrotreated vacuum gas oil feedstock having the properties listed in Table 1 was contacted with a volume of 90% acetic acid at 60° C. using a solvent/oil volume ratio of 3.0. The phases were allowed to separate. The raffinate phase was flashed at a temperature well below the initial boiling point of the feedstock but well above the boiling point of water and acetic acid to remove residual acid in water. The resulting flashed material constituted the first recovery stream of denitrogenated raffinate product. The product raffinate exhibited a basic nitrogen level of 230 ppm, representing a basic nitrogen removal efficiency of 85% (Table 2). The raffinate yield of the single-step process, that is to say the weight of denitrogenated raffinate divided by the weight of feedstock treated, was 92.3% w. The extract stream from the first contacting step was flashed at a temperature well below the initial boiling point of the feedstock but well above the boiling points of water and acetic acid to remove bulk acid and water from the high-nitrogen extract.

To the flashed extract stream from the first contacting step were added glacial acetic acid and water in weight ratios 4.3 g acetic acid plus 0.48 g water per gram of extract. This reconstituted extract phase was then contacted with a volume of n-octane at 60° C. an octane/extract phase volume ratio of 0.6. The phases were allowed to separate. The hydrocarbon solvent phase from the second contacting step was flashed at a temperature well below the initial boiling point of the feedstock but above the boiling point of n-octane to remove the solvent. The resulting flashed material was added to the first recovery stream of denitrogenated raffinate product to give the two-step process denitrogenated raffinate product. The extract or acidic phase from the second contacting step was flashed at a temperature well below the initial boiling point of the feedstock but above the boiling points of acetic acid and water to remove residual acid and water. The residue from this flash constituted the process extract stream.

The product raffinate for the two-step process exhibited a basic nitrogen level of 250 ppm, representing a basic nitrogen removal efficiency of 83% (Table 2). The raffinate yield of the two-step process was 96.0% w. By the incorporation of the instant invention, i.e., the second step of the two-step process, the raffinate yield improved from 92.3% w to 96.0% w. The observed major reduction in raffinate yield loss was accompanied by only a small reduction in basic nitrogen removal efficiency, i.e., from 85% to 83%. From molecular weight data, it is known that the theoretical yield for the removal of 83-85% basic nitrogen in 96.6% w. Thus, process selectivity was improved from 44% to 85% (Table 2) by the incorporation of the instant invention. The extract stream generated by the two-step process contains only 15% w nitrogen-free hydrocarbons, whereas the extract stgream generated by the one-step process contains 56% w nitrogen-free hydrocarbons. It is important to recognize that this represents a reduction of in the loss of nitrogen-free hydrocarbon by a factor of 4 (Table 2).

Example 2

Example 2 also illustrates the embodiment of the invention depicted in FIG. 2. In this example, as in the preceding example, a hydrotreated vacuum gas oil feedstock having the properties listed in Table 1 was contacted with a volume of 90% acetic acid at 50° C. using a solvent/oil volume ratio of 3.0. The phases were allowed to separate. The raffinate phase was flashed at a temperature well below the initial boiling point of the feedstock but well above the boiling points of water and acetic acid to remove residual acid and water. The resulting flashed material constituted the first recovery stream of denitrogenated raffinate product. The product raffinate exhibited a basic nitrogen level of 230 ppm, representing a basic nitrogen removal efficiency of 85% (Table 3). The raffinate yield of the single-step process, that is to say the weight of denitrogenated raffinate divided by the weight of feedstock treated, was 92.3% w.

The extract stream was then contacted with a volume of n-octane at 60° C. using an octane/extract phase volume ratio of 0.4. The phases were allowed to separate. The hydrocarbon solvent phase from the second contacting step was flashed at a temperature well below the initial boiling point of the feedstock but above the boiling point of n-octane to remove the solvent. The resulting flashed material was added to the first recovery stream of denitrogenated raffinate product. The extract or acidic phase from the second contacting step was flashed at a temperature well below the initial boiling point of the feedstock but above the boiling points of acetic acid and water to remove residual acid and water. The residue from this flash constituted the process extract stream.

The product raffinate for the two step process exhibited a basic nitrogen level of 340 ppm, representing a basic nitrogen removal efficiency of 77% (Table 3). The raffinate yield of the two-step process was 96.7% w. By the incorporation of the instant invention, i.e., the second step of the two-step process, the raffinate yield improved from 92.3% w to 96.7%w. The observed major reduction in raffinate yield loss was accompanied by only a small reduction in basic nitrogen removal efficiency, i.e., from 85% to 77%. Had the recovery stream from the second contacting step been utilized in the recycle mode, as is described by FIG. 1, the two-step extraction would have achieved an even higher degree of basic nitrogen removal. From molecular weight data, it is known that the theoretical yields for the removal of 85% and 77% basic nitrogen are 96.6% w and 96.8% w, respectively. Thus, process selectivity was improved from 44% to 97% (Table 3) by the incorporation of the instant invention. The extract stream generated by the two-step process contains only 3% w nitrogen-free hydrocarbons, whereas the extract stream generated by the one-step process contains 56% w nitrogen-free hydrocarbons. It is important to recognize that this represents a reduction of in the loss of nitrogen-free hydrocarbon by a factor of 18 (Table 3).

A comparison of Examples 1 and 2 illustrates the point that by adjusting the relative amounts of extract from the first contacting step, acid, water and immiscible hydrocarbon solvent that participate in the second contacting step, the process nitrogen removal efficiency and raffinate yield can be manipulated. Improvements in process selectivity are gained at the expense of some nitrogen removal efficiency. However, in both examples, the application of the instant invention resulted in the removal of high levels of basic nitrogen at exceptionally high raffinate yields.

TABLE 1

| Feedstock Properties | |
|---|---|
| Feed Type | Lightly Hydrotreated West Coast Vacuum Gas Oil Blend |
| Basic Nitrogen | 1485 ppm |
| Total Nitrogen | 4015 ppm |
| Sulfur | 0.20% w |
| Aromatics | 17.0% w |
| Density (60° F.) | 0.943 g/cc |

TABLE 2

Performance Comparison of Two-Step Extraction Versus Single-Step Extraction, No Recycle (Example 1)

| Extraction Procedure | Feedstock Basic Nitrogen (ppm) | Product Basic Nitrogen (ppm) | Basic Nitrogen Removal (ppm) | Observed Raffinate Yield (% w) | Theoretical Yield at 100% Selectivity (% w) | Process Selectivity (% w) |
|---|---|---|---|---|---|---|
| Single-Step | 1485 | 230 | 85% | 92.3% | 96.6% | 44% |
| Two-Step | 1485 | 250 | 83% | 96.0% | 96.6% | 85% |

*Raffinate Yield at 100% Selectivity based on average molecular weight of basic nitrogen compounds extracted

*Process Selectivity = (100% - Theoretical Yield at 100% Selectivity)/(100 - Observed Raffinate Yield)

TABLE 3

Performance Comparison of Two-Step Extraction Versus Single-Step Extraction, No Recycle (Example 2)

| Extraction Procedure | Feedstock Basic Nitrogen (ppm) | Product Basic Nitrogen (ppm) | Basic Nitrogen Removal (ppm) | Observed Raffinate Yield (% w) | Theoretical Yield at 100% Selectivity (% w) | Process Selectivity (% w) |
|---|---|---|---|---|---|---|
| Single-Step | 1485 | 230 | 85% | 92.3% | 96.6% | 44% |
| Two-Step | 1485 | 340 | 77% | 96.7% | 96.8% | 97% |

*Raffinate Yield at 100 Selectivity based on average molecular weight basic nitrogen compounds extracted

*Process Selectivity = (100% - Theoretical Yield at 100% Selectivity)/(100% - Observed Raffinate Yield)

What is claimed is:

1. A process for the removal of basic heterocyclic nitrogen compounds from petroleum oils which comprises:

(a) contacting said petroleum oils containing basic heterocyclic nitrogen compounds with an aqueous solution of an acidic solvent at extraction conditions in a first contacting zone, (b) separating the product of step (a) into a raffinate product stream comprising hydrocarbons having a lean content of basic heterocyclic nitrogen compounds and residual acid levels, and a first extract phase comprising hydrocarbons, water and acid having a substantial content of basic heterocyclic nitrogen compounds, (c) contacting said first extract phase with a hydrocarbon solvent that is substantially immiscible with said first extract phase at extraction conditions in a second contacting zone, and (d) separating the product of step (c) into a hydrocarbon recovery stream comprising the immiscible hydrocarbon solvent and oil-derived hydrocarbons having a lean content of basic heterocyclic nitrogen compounds and a second extract phase comprising acid, water, a high content of basic heterocyclic compounds and a decreased amount of nitrogen-free hydrocarbons.

2. The process of claim 1 wherein said acidic solvent has a concentration in the range of from about 25% by weight to about 99% by weight, per total weight of solvent.

3. The process of claim 2 wherein said acidic solvent has an acid concentration in the range of from about 75% by weight to about 95% by weight, per total weight of solvent.

4. The process of claim 1 wherein acidic solvent comprises an acid selected from the group consisting of aliphatic organic carboxylic acids, halogen-substituted carboxylic acids and mixtures thereof.

5. The process of claim 1 wherein said hydrocarbon solvent is selected from the group consisting of $C_3$–$C_{12}$ paraffins, $C_3$–$C_{12}$ olefins and $C_3$–$C_{12}$ ethers.

6. The process of claim 1, wherein said extraction conditions include a temperature in the range of from ambient temperature to about 300° F. and a pressure in the range of from about 1 atmosphere to about 20 atmospheres.

7. The process of claim 1 wherein prior to step (c), said first extract phase is subjected to partial flashing.

8. The process of claim 1 wherein prior to step (c), said first extract phase is subjected to a full flash followed by reconstitution by adding some acid and water back to the flashed first extract phase.

9. The process of claim 1 or 8 wherein said recovery stream in step (e) is combined with said petroleum oils in step (a) and recycled.

10. The process of claim 1 or 8 wherein said recovery stream in step (e) is combined with said raffinate product stream from step (b) and passed downstream for further processing.

11. A process for the removal of basic heterocyclic nitrogen compounds from petroleum oils which comprises:

(a) contacting said petroleum oils containing basic heterocyclic nitrogen compounds with an aqueous solution of an acidic solvent at extraction conditions in a first contacting zone, (b) separating the product of step (a) into a raffinate product stream comprising hydrocarbons having a lean content of basic heterocyclic nitrogen compounds and residual acid levels, and a first extract phase comprising hydrocarbons, water and acid having a substantial content of basic heterocyclic nitrogen compounds, (c) contacting said first extract phase with a hydrocarbon solvent that is substantially immiscible with said first extract phase wherein said hydrocarbon solvent and extraction conditions are selected such that the ratio of nitrogen-free oil distribution coefficient to basic nitrogen distribution coefficient is greater than about 10 in a second contacting zone, and (d) separating the product oil step (c) into a hydrocarbon recovery stream comprising the immiscible hydrocarbon solvent and oil-derived hydrocarbons having a lean content of basic heterocyclic nitrogen compounds and a second extract phase comprising acid, water, a high content of basic heterocyclic compounds and a decreased amount of nitrogen-free hydrocarbons.

12. A process for the removal of basic heterocyclic nitrogen compounds from petroleum oils which comprises:

(a) contacting said petroleum oils containing basic heterocyclic nitrogen compounds with an aqueous solution of an acidic solvent selected from the group consisting of aliphatic organic carboxylic acids, halogen-substituted carboxylic acids and mixtures thereof, at extraction conditions in a first contacting zone, (b) separating the product of step (a) into a raffinate product stream comprising hydrocarbons having a lean content of basic heterocyclic nitrogen compounds and residual acid levels, and a first extract phase comprising hydrocarbons, water and acid having a substantial content of basic heterocyclic nitrogen compounds, (c) contacting said first extract phase with a non-polar hydrocarbon solvent that is substantially immiscible with said first extract phase at extraction conditions in a second contacting zone, and (d) separating the product of step (c) into a hydrocarbon recovery stream comprising the immiscible hydrocarbon solvent and oil-derived hydrocarbons having a lean content of basic heterocyclic nitrogen compounds and a second extract phase comprising acid, water, a high content of basic heterocyclic compounds and a decreased amount of nitrogen-free hydrocarbons.

13. The process of claim 12 wherein said acidic solvent has a concentration in the range of from about 25% by weight to about 99% by weight, per total weight of solvent.

14. The process of claim 13 wherein said acidic solvent has an acid concentration in the range of from about 75% by weight to about 95% by weight, per total weight of solvent.

15. The process of claim 12 wherein said non-polar hydrocarbon solvent is selected from the group consisting of $C_3$–$C_{12}$ paraffins, $C_3$–$C_{12}$ olefins and aromatics.

16. The process of claim 12 wherein said extraction conditions include a temperature in the range of from ambient temperature to about 300° F. and a pressure in the range of from about 1 atmosphere to about 20 atmospheres.

17. The process of claim 12 wherein prior to step (c), said first extract phase is subjected to partial flashing.

18. The process of claim 12 wherein prior to step (c), said first extract phase is subjected to a full flash followed by reconstitution by adding some acid and water back to the flashed first extract phase.

19. The process of claim 12, 17 or 18 wherein said recovery stream in step (e) is combined with sad petroleum oils in step (a) and recycled.

20. The process of claim 12, 17 or 18 wherein said recovery stream in step (e) is combined with said raffinate product stream from step (b) and passed downstream for further processing.

21. A process for the removal of basic heterocyclic nitrogen compounds from petroleum oils which comprises:

(a) contacting said petroleum oils containing basic heterocyclic nitrogen compounds with an aqueous solution of an acidic solvent having an acid concentration in the range of from about 25% by weight to about 99% by weight, per total weight of solvent at extraction conditions in a first contacting zone, (b) separating the product of step (a) into a raffinate product stream comprising hydrocarbons having a lean content of basic heterocyclic nitrogen compounds and residual acid levels, and a first extract phase comprising hydrocarbons, water and acid having a substantial content of basic heterocyclic nitrogen compounds, (c) contacting said first extract phase with a non-polar hydrocarbon solvent that is substantially immiscible with said first extract phase at extraction conditions in a second contacting zone, and (d) separating the product of step (c) into a hydrocarbon recovery stream comprising the immiscible hydrocarbon solvent and oil-derived hydrocarbons having a lean content of basic heterocyclic nitrogen compounds and a second extract phase comprising acid, water, a high content of basic heterocyclic compounds and a decreased amount of nitrogen-free hydrocarbons.

22. The process of claim 1 wherein said acidic solvent has a concentration in the range of from about 75% by weight to about 95% by weight, per total weight of solvent.

23. The process of claim 21 wherein acidic solvent comprises an acid selected from the group consisting of aliphatic organic carboxylic acids, halogen-substituted carboxylic acids and mixtures thereof.

24. The process of claim 21 wherein said hydrocarbon solvent is selected from the group consisting of $C_3$–$C_{12}$ paraffins, $C_3$–$C_{12}$ olefins and aromatics.

25. The process of claim 21 wherein said extraction conditions include a temperature in the range of from ambient temperature to about 300° F. and a pressure in the range of from about 1 atmosphere to about 20 atmospheres.

26. The process of claim 21 wherein prior to step (c), said first extract phase is subjected to partial flashing.

27. The process of claim 21 wherein prior to step (c), said first extract phase is subjected to a full flash followed by reconstitution by adding some acid and water back to the flashed first extract phase.

28. The process of claim 21, 26 or 27 wherein said recovery stream in step (e) is combined with said petroleum oils in step (a) and recycled.

29. The process of claim 21, 26 or 27 wherein said recovery stream in step (e) is combined with said raffinate product stream from step (b) and passed downstream for further processing.

* * * * *